US009341029B2

(12) United States Patent
Roodenburg et al.

(10) Patent No.: US 9,341,029 B2
(45) Date of Patent: May 17, 2016

(54) VESSEL INCLUDING A DRILLING INSTALLATION, AND A METHOD OF DRILLING A WELL USING THE SAME

(71) Applicant: ITREC B.V., Schiedam (NL)

(72) Inventors: Joop Roodenburg, Delft (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 14/437,440

(22) PCT Filed: Oct. 18, 2013

(86) PCT No.: PCT/NL2013/050736

§ 371 (c)(1),
(2) Date: Apr. 21, 2015

(87) PCT Pub. No.: WO2014/065655

PCT Pub. Date: May 1, 2014

(65) Prior Publication Data

US 2015/0275585 A1 Oct. 1, 2015

(30) Foreign Application Priority Data

Oct. 22, 2012 (NL) ..... 2009677

(51) Int. Cl.
*E21B 7/12* (2006.01)
*E21B 15/02* (2006.01)
*B63B 35/44* (2006.01)

(52) U.S. Cl.
CPC ..... *E21B 15/02* (2013.01); *B63B 35/4413* (2013.01); *E21B 7/12* (2013.01)

(58) Field of Classification Search
CPC ..... E21B 7/12; E21B 15/02; E21B 19/002; B63B 35/44; B63B 35/4413
USPC ..... 175/5; 166/352, 358; 405/195.1, 217
See application file for complete search history.

(56) References Cited

U.S. PATENT DOCUMENTS 4,613,001 A * 9/1986 Edberg et al. ..... 175/52
4,629,014 A * 12/1986 Swisher et al. ..... 175/220

(Continued)

FOREIGN PATENT DOCUMENTS

WO WO 0218742 A1 * 3/2002
WO WO 2008/100151 A1 8/2008

(Continued)

*Primary Examiner* — Matthew R Buck
(74) *Attorney, Agent, or Firm* — Birch, Stewart, Kolasch & Birch, LLP

(57) ABSTRACT

The invention relates to a vessel including a drilling installation for drilling a well, which installation comprises: —a drill floor surrounding a firing line; —a first drilling tower arranged on a deck of the vessel, comprising a frame with two elongated hollow casings, which extend parallel to a longitudinal axis of the frame, are rigidly connected to each other by connection elements, wherein the frame is positioned at a side of the drill floor, such that the longitudinal axis of the frame extends parallel to the firing line, and such that the longitudinal axis and the firing line are substantially aligned with each other in a width direction of the frame; —an additional tower support arranged between the deck of the vessel and an elevated position at the first drilling tower; —two storage devices for vertically storing drilling tubulars; —two pipe rackers, each pipe racker being associated with one of the two storage devices, and each pipe racker being configured to move drilling tubulars between the associated storage device and the firing line, wherein the two storage devices are positioned at opposite sides of the drill floor, such that the storage devices and the drill floor are aligned with each other in a thickness direction of the frame, and wherein the casings of the frame of the first drilling tower each support one of the two pipe rackers.

17 Claims, 4 Drawing Sheets

(56) References Cited

U.S. PATENT DOCUMENTS

| | | | | |
|---|---|---|---|---|
| 6,763,898 | B1 * | 7/2004 | Roodenburg et al. | 175/7 |
| 7,938,598 | B2 * | 5/2011 | Roodenburg et al. | 405/168.4 |
| 8,905,676 | B2 * | 12/2014 | Roodenburg et al. | 405/168.3 |
| 8,956,079 | B2 * | 2/2015 | Roodenburg et al. | 405/169 |
| 2010/0116507 | A1 * | 5/2010 | Haugland | 166/352 |
| 2010/0300697 | A1 * | 12/2010 | Wijning et al. | 166/352 |
| 2011/0036287 | A1 * | 2/2011 | Wijning et al. | 114/74 R |
| 2012/0103623 | A1 | 5/2012 | Wijning et al. | |
| 2014/0102803 | A1 * | 4/2014 | Storhaug et al. | 175/162 |

FOREIGN PATENT DOCUMENTS

| | | | | |
|---|---|---|---|---|
| WO | WO 2010126357 | A1 * | 11/2010 | E21B 19/14 |
| WO | WO 2012/087119 | A1 | 6/2012 | |

* cited by examiner

VESSEL INCLUDING A DRILLING INSTALLATION, AND A METHOD OF DRILLING A WELL USING THE SAME

The invention relates to a vessel including a drilling installation for drilling a well, for example an oil, a gas, or a thermal well, by means of said installation. The invention also relates to a method of drilling a well, wherein use is made of such a vessel.

Many prior art vessels including drilling installation are known, for instance from the applicant. A disadvantage of current drilling installations is that they are most of the time bulky and heavy. As safety plays an important role during drilling operations, these bulky and heavy designs have been well accepted by the industry as they at least give the impression of robustness and safety. However, recently there is a development towards constructions in which an optimized balance between for instance weight and strength is sought while also being able to easily perform all necessary handling of drilling tubulars and other accessories. This has for instance resulted in mast-like designs, such as disclosed in US2012/0103623 A1 of the applicant.

However, although the mast-like designs have many advantages, there is a continuous search for optimized designs with other or additional advantages.

It is therefor an object of the invention to provide an alternative drilling installation with favourable weight and of sufficient strength while allowing easy handling of drilling tubulars and other accessories.

The object is at least partially achieved by a vessel including a drilling installation according to claim 1. An advantage of the drilling installation according to the invention is the use of hollow casings, which have the advantage of being strong, especially for bending, while using a minimum of material, thereby keeping the weight at a low level. By designing the casings such that they are the load carrying elements of the drilling installation, additional structural components can be minimized thereby keeping enough space and room for other equipment and handling of the drilling tubulars.

The frame of the first drilling tower may be designed such that the casings are able to withstand all bending moments applied to the first drilling tower, but this may result in an increase in weight or size that is relatively large with respect to the gained additional resistance to bending moments, therefor an additional advantage of the drilling installation according to the invention is the use of an additional tower support that is arranged between the deck of the vessel and an elevated position at the first drilling tower. The additional tower support can specifically be configured to absorb bending moments applied to the first drilling tower, thereby strengthening the first drilling tower while keeping the added mass to a minimum and while keeping the occupied space to a minimum. The additional tower support may for instance also comprise hollow casing portions, preferably, the entire additional tower support is made of hollow casings to reduce weight while ensuring sufficient strength.

The strength of the casings is further advantageously used to carry other equipment, such as the pipe rackers, thereby making additional supports for these equipment components superfluous and thus reducing the weight and occupied space. The casings may also support rails along which a trolley for a traveling block can be guided, said rails extending then parallel to the firing line.

Another advantage of the two casings is that in between them spaces can be provided to store or place equipment in, which equipment is then close to the firing line. In an embodiment, the casings are only rigidly connected to each other by substantially horizontal connection elements, preferably only substantially horizontal connection elements, thereby forming rectangular compartments in between the casings where e.g. a top drive can be temporarily stored, or a heave compensator can be positioned, or any other equipment. The compartments can also advantageously be used to introduce equipment or drilling tubulars into the firing line if necessary.

In an embodiment, the drilling installation includes a second drilling tower comprising a vertically extending frame with a length, a width and a thickness, the length of the frame of the second drilling tower being larger than the width of the frame of the second drilling tower, and the width of the frame of the second drilling tower being larger than the thickness of the frame of the second drilling tower, wherein the frame of the second drilling tower comprises two elongated hollow casings arranged next to each other in the width direction of the frame of the second drilling tower, said casings of the frame of the second drilling tower extending substantially parallel to a longitudinal axis of the frame of the second drilling tower, said casings of the frame of the second drilling tower being rigidly connected to each other by one or more connection elements, and said casings of the frame of the second drilling tower being configured to transfer loads applied to the second drilling tower to the vessel, wherein the frame of the second drilling tower is positioned at a side of the drill floor opposite to the frame of the first drilling tower, such that the longitudinal axis of the frame of the second drilling tower extends parallel to the firing line, and such that the longitudinal axis of the frame of the second drilling tower and the firing line are substantially aligned with each other in the width direction of the frame of the second drilling tower, and wherein the second drilling tower is the additional tower support of the first drilling tower.

This embodiment has the advantage that the additional tower support is similar to the first drilling tower and thus a more symmetric design is obtained. In other words, the additional tower support now makes use of the same advantages as the first drilling tower. One of these advantages is that the casings occupy minimal space and that the space in between the casings can be used, for instance to introduce riser strings or accessories into the firing line, which are or cannot be stored in the two storage devices.

In an embodiment, the first and second drilling tower are connected to each other at their respective top ends, preferably only at their top ends.

In an embodiment, the width of the frame of the first drilling tower and the frame of the second drilling tower, if present, is substantially equal to the dimension of the drill floor in the width direction of the frame of the first drilling tower, so that the storage devices are located next to the frame of the first drilling tower seen in width direction of the frame of the first drilling tower. In case the second drilling tower is present, the storage devices are preferably positioned outside the footprint seen in plan view defined by the frames of the first and second drilling towers. As a result thereof the casings are positioned at favorable locations between the storage devices and the firing line to support equipment such as the pipe rackers, etc., which is then able to reach both the storage devices and the firing line. Prior art drilling installation often have the disadvantage that the supporting column members are positioned at a relatively large distance to the firing line.

The combination of the first and second drilling tower being present, the storage devices being located outside the space in between the frames of the first and second drilling towers, and the first and second drilling tower being connected to each other at their respective ends only, ensures that vertically handled drilling tubulars can still be moved between the storage devices outside said space and the firing line located in said space without being interfered by the first or second drilling tower. Hence, in side view, there is an opening present that is sufficiently large for a drilling tubular to pass, wherein the height of the opening between the frames of the first and second drilling tower is preferably at least as large as the largest drilling tubular that can be stored in the storage devices.

In an embodiment, the drilling installation comprises two additional pipe rackers, each of the two additional pipe rackers being associated with one of the two storage devices, and each additional pipe racker being configured to move drilling tubulars between the associated storage device and the firing line, wherein the casings of the frame of the second drilling tower each support one of the two additional pipe rackers. This has the advantage of providing additional redundancy in case a pipe racker fails or is out of service due to maintenance.

In an embodiment, the drilling installation comprises weather protective cladding surrounding the drill floor, the first drilling tower, the second drilling tower and the two storage devices, wherein the cladding is supported by the casings of the first and second drilling tower. This makes the drilling installation suitable to be used in harsh environments such as the arctic regions. Hence, again, the strength of the casings is used to support other equipment.

In an embodiment, the drilling installation comprises draw-works and a traveling block for supporting a top drive, said draw-works being configured to move the traveling block up and down in the firing line, wherein the drilling installation further comprises a trolley which is connectable to the traveling block, and guides, e.g. rails, extending parallel to the firing line and being supported by the casings of the frame of the first drilling tower to guide movement of the trolley along the first drilling tower.

In an embodiment, the draw-works comprise a winch that is located outside the space enclosed by the weather protective cladding, although the winch may be provided in a separate protected compartment to be protected from environmental weather conditions as well.

In an embodiment, the storage devices are rotary storage devices, preferably with a vertical column and one or more fingerboards supported by the column, as well as with a drive motor for rotating the rotary storage device.

In an embodiment, the drilling installation comprises a cabin for drilling personnel, said cabin being arranged at least partially beneath one of the two storage devices at or near the drill floor.

It is specifically noted here that although many components and equipment is described in relation to the first drilling tower, the use of a second drilling tower as additional tower support makes it possible that equipment or components described above as being support by the first drilling tower may alternatively or additionally be also supported by the second drilling tower when appropriate. As an example, the pipe rackers or the guides for the trolley for the traveling block may be supported by the second drilling tower instead of the first drilling tower while the other components are still supported by the first drilling tower. That is the advantage of using a second drilling tower that is similar in construction as the first drilling tower.

The invention also relates to a method of drilling a well, wherein use is made of a vessel according to the invention.

The invention will now be described in a non-limiting way with reference to the accompanying drawings in which like parts are indicated by like reference symbols and in which.

Figure 1:
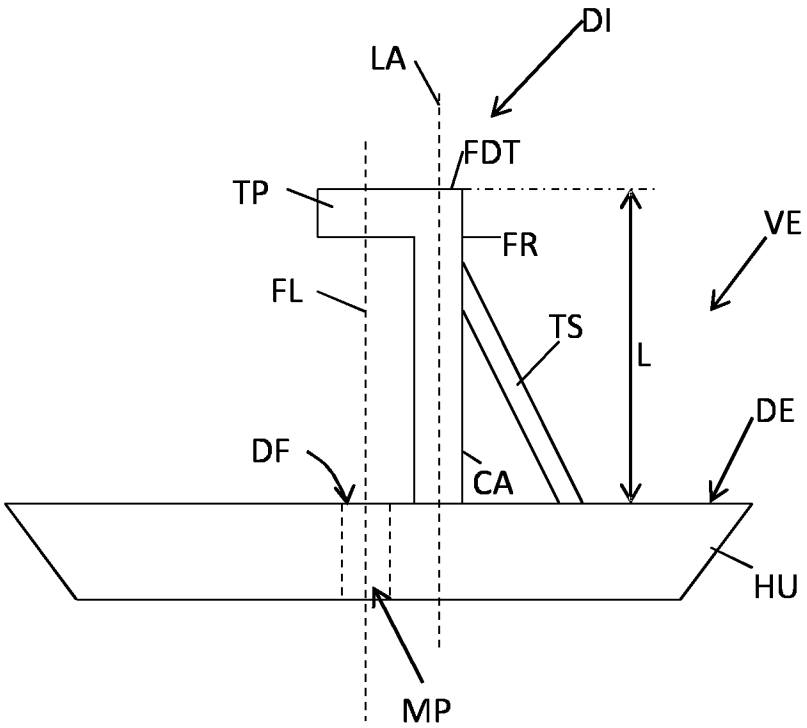
FIG. 1 depicts a vessel including a drilling installation according to an embodiment of the invention.
Figure 2:
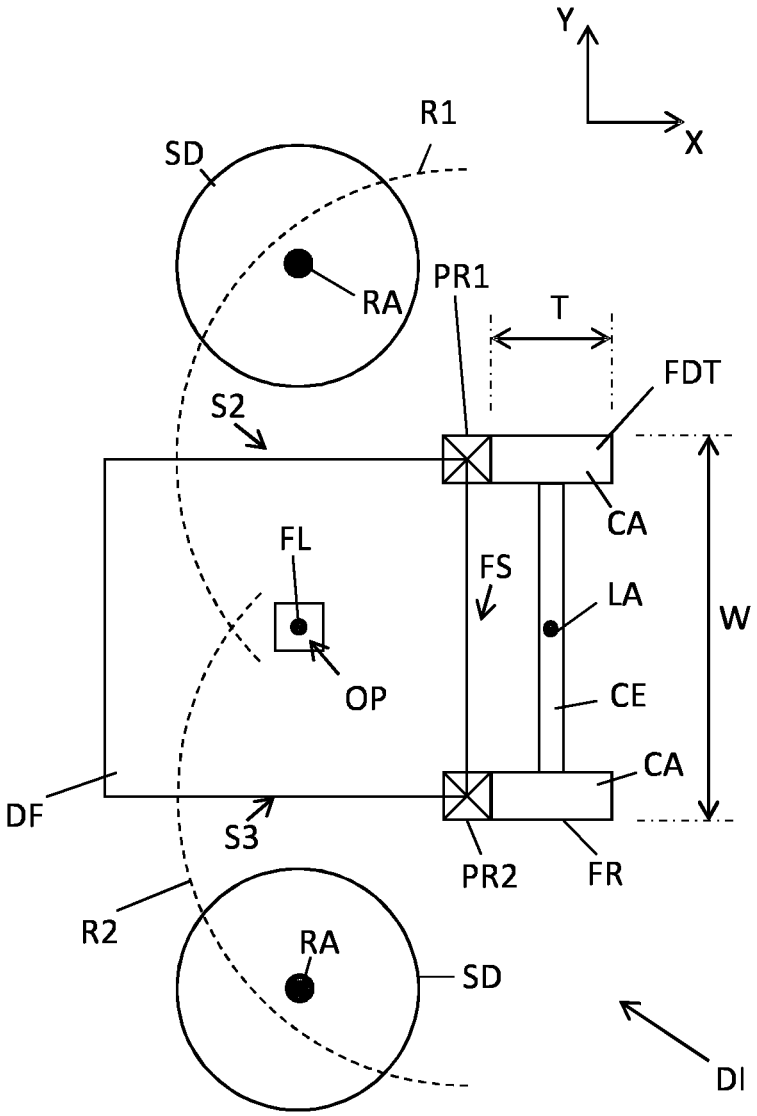
FIG. 2 depicts a cross sectional top view of the drilling installation of FIG. 1.

FIGS. 1 and 2 schematically depict a vessel including a drilling installation according to an embodiment of the invention. FIG. 1 depicts a side view of the vessel and FIG. 2 depicts a cross sectional top view of the drilling installation. For clarity reasons, not all components of the vessel and drilling installation are depicted in both figures.

FIGS. 1 and 2 depict a vessel VE with a hull HU, here a monohull, a moonpool MP, a deck DE and a drilling installation DI. The drilling installation DI comprises a substantially rectangular drill floor DF surrounding a vertically extending firing line FL and at least covering part of the moonpool MP. The drill floor DF may be a single structural element with an opening OP for allowing drilling tubulars in the firing line FL to pass the drill floor, but may alternatively be composed of multiple structural elements, such as moveable hatches, which together can form a substantially rectangular drill floor and leave an opening free in between the structural elements for the firing line. The drill floor may be used by personnel to get in close proximity of the firing line. The drill floor DF may be moveable, e.g. to allow the passing of relatively large objects. The drill floor DF may be part of or be integral with the deck DE of the vessel.

Arranged on the deck DE of the vessel is a first drilling tower FDT. The first drilling tower comprises a vertically extending frame FR with a length L, a width W and a thickness T, wherein the length L of the frame of the first drilling tower is larger than the width W of the frame of the first drilling tower, and wherein the width W of the frame of the first drilling tower is larger than the thickness T of the frame of the first drilling tower.

The frame FR comprises two elongated hollow casings CA arranged next to each other in the width direction of the frame, which width direction is parallel to direction Y indicated in FIG. 2. The casings CA extend parallel to a longitudinal axis LA of the frame FR and are rigidly connected to each other by one or more connection elements CE. The casings CA are further connected to the deck DE of the vessel in order to transfer loads applied to the first drilling tower to the vessel.

The frame of the first drilling tower is positioned at a first side FS of the drill floor, such that the longitudinal axis LA of the frame FR extends parallel to the firing line FL, and such that the longitudinal axis of the frame and the firing line are substantially aligned with each other in the width direction of the frame. As a result thereof, the firing line is located at a distance from the frame, wherein a distance from the firing line to one of the two casings of the frame is substantially equal to a distance from the firing line to the other one of the two casings of the frame.

Because the firing line is spaced from the frame FR, the first drilling tower FDT may comprise a top part TP connected to the frame FR to support equipment, e.g. equipment used for manipulation of drilling tubulars in the firing line, in the firing line. The equipment may for instance comprise a traveling block which can be used to carry a top drive and which can be moved up and down in the firing line using draw-works and a crown block provided at the top part TP.

The advantage of using a frame as described above is that a relatively light-weight and open structure of the first drilling tower is obtained while still being able to withstand the relatively large loads applied to it.

Due to the firing line being spaced from the frame of the first drilling tower, relatively large bending moments may be introduced to the frame. Constructing the frame in such a manner that it is able to withstand these bending moments may result in a more heavy frame. To avoid this, the drilling installation preferably comprises an additional tower support TS arranged between the deck of the vessel and an elevated position at the first drilling tower. In FIG. 1, the additional tower support is shown in a configuration in which it is provided on a side of the frame opposite the drill floor. However, alternatively or additionally, the additional tower support can be provided on a drill floor side of the first drilling tower.

The drilling installation further comprises two storage devices SD, in this embodiment rotary storage devices, for vertically storing drilling tubulars. The two storage devices are positioned at opposite sides S2, S3 of the drill floor, such that the storage devices and the drill floor are aligned with each other in the thickness direction of the frame of the first drilling tower, which thickness direction is parallel to the X direction indicated in FIG. 2. Preferably, the storage devices are aligned with the firing line in the thickness direction. In case of rotary storage devices it is preferred that the rotation axes RA of the rotary storage devices are substantially aligned with the firing line. The rotary storage devices preferably comprise a vertical column and one or more fingerboards supported by the column, as well as a drive motor for rotating the rotary storage device.

The drilling installation further comprises two pipe rackers PR1, PR2, each pipe racker being associated with one of the two storage devices, and each pipe racker being configured to move drilling tubulars between the associated storage device and the firing line. The casings CA of the frame of the first drilling tower each support one of the two pipe rackers.

The pipe rackers PR1, PR2 each include multiple, e.g. two, gripping members which are mounted on a motion device, e.g. an articulated arm, allowing to displace the gripping member within a reach R1, R2 respectively for the pipe racker PR1, PR2 outside of the respective casing CA to which the gripping member is mounted.

Some or all of the gripping members of a pipe racker may be vertically displaceable along the casing CA, e.g. by an associated cable and winch, in order to adjust the height position of the gripping member to the drilling tubulars to be handled.

Figure 3:
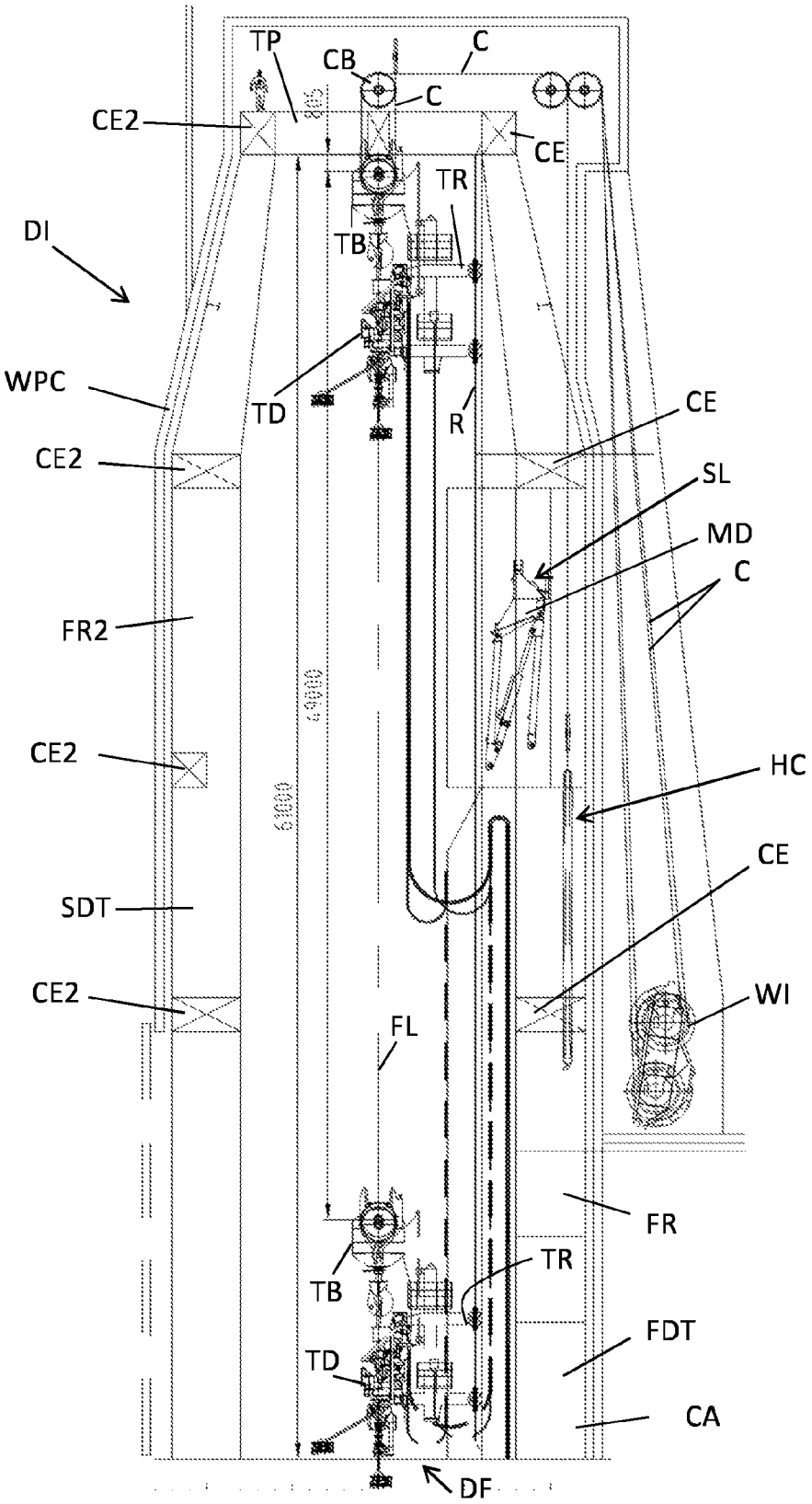
FIG. 3 depicts a longitudinal cross section of a drilling installation for use on a vessel according to another embodiment of the invention.
Figure 4:
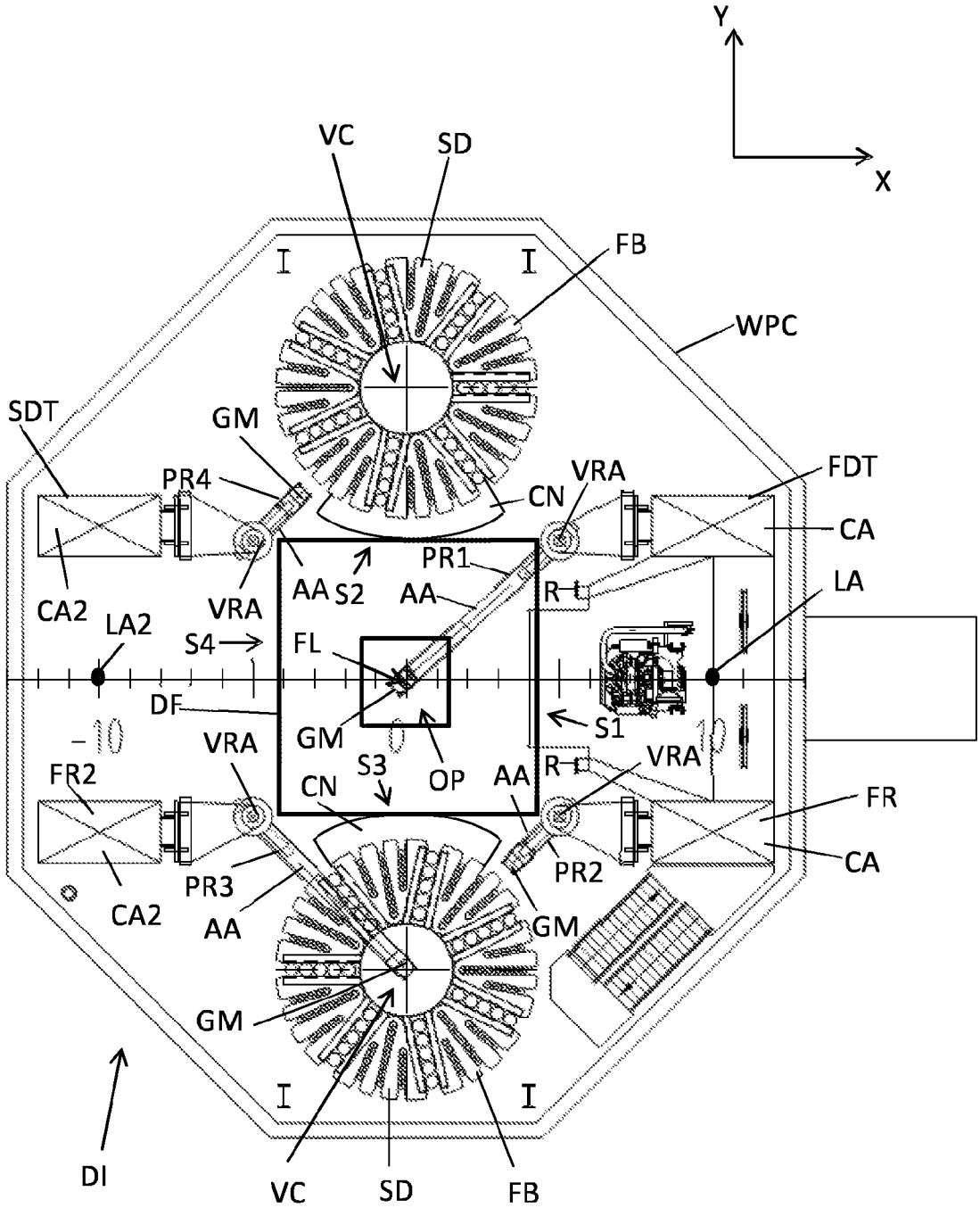
FIG. 4 depicts a horizontal cross section of the drilling installation of FIG. 3.

FIGS. 3 and 4 depict two views of a drilling installation DI to be placed on a vessel according to another embodiment of the invention. FIG. 3 depicts a longitudinal cross section of the drilling installation and FIG. 4 depicts a cross section of the drilling installation perpendicular to the longitudinal cross section.

Shown are a substantially rectangular drilling floor DF surrounding a vertically extending firing line FL, a first drilling tower FDT to be arranged on a deck of a vessel, a second drilling tower SDT to be arranged on a deck of the vessel, two storage devices SD, and four pipe rackers PR1, PR2, PR3, PR4.

The first drilling tower comprises a vertically extending frame FR with a length, a width and a thickness, which are not indicated here by reference symbols, but which are similar to the ones indicated in FIGS. 1 and 2. The length of the frame of the first drilling tower is larger than the width of the frame of the first drilling tower, and the width of the frame of the first drilling tower is larger than the thickness of the frame of the first drilling tower. The frame of the first drilling tower comprises two elongated hollow casings CA arranged next to each other in the width direction of the frame, which width direction in FIG. 4 is parallel to the Y direction indicated in FIG. 4. The casings CA extend substantially parallel to a longitudinal axis LA of the frame FR of the first drilling tower. The casings CA are rigidly connected to each other by multiple connection elements CE, in this embodiment, substantially horizontal connection elements CE. The casings CA further are configured to transfer loads applied to the first drilling tower to the vessel. The frame FR of the first drilling tower is positioned at a side S1 of the drill floor, such that the longitudinal axis LA of the frame FR extends parallel to the firing line FL, and such that the longitudinal axis LA and the firing line FL are substantially aligned with each other in the width direction, i.e. the Y direction in FIG. 4, of the frame FR.

The second drilling tower SDT comprises a vertically extending frame FR2 with a length, a width and a thickness, which are nor indicated here by reference symbols, but which are similar to the ones indicated in FIGS. 1 and 2 for the frame of the first drilling tower. The length of the frame FR2 of the second drilling tower being larger than the width of the frame FR2 of the second drilling tower, and the width of the frame FR2 of the second drilling tower being larger than the thickness of the frame FR2 of the second drilling tower. The frame FR2 of the second drilling tower comprises two elongated hollow casings CA2 arranged next to each other in the width direction of the frame FR2 of the second drilling tower, i.e. the Y direction in FIG. 4. The casings CA2 of the frame FR2 of the second drilling tower extend substantially parallel to a longitudinal axis LA2 of the frame FR2 of the second drilling tower. The casings CA2 of the frame FR2 of the second drilling tower are rigidly connected to each other by multiple, in this embodiment substantially horizontal, connection elements CE2. The casings CA2 of the frame FR2 of the second drilling tower further are configured to transfer loads applied to the second drilling tower to the vessel. The frame FR2 of the second drilling tower is positioned at a side S4 of the drill floor opposite to the frame FR of the first drilling tower, such that the longitudinal axis LA2 of the frame FR2 of the second drilling tower extends parallel to the firing line FL, and such that the longitudinal axis LA2 of the frame FR2 of the second drilling tower and the firing line FL are substantially aligned with each other in the width direction of the frame FR2 of the second drilling tower, i.e. the Y direction indicated in FIG. 4.

The second drilling tower advantageously acts an additional tower support of the first drilling tower as it is able to provide additional resistance against bending moments applied to the first drilling tower. The first and second drilling towers are therefor connected to each other at their top ends, thereby forming a top part TP which is supported at two opposite sides and thus a stable and rigid construction is formed. Hence, the second drilling tower is arranged between the deck and an elevated position at the first drilling tower.

The two storage devices are configured to vertically store drilling tubulars and each comprise a vertical column VC and one or more fingerboards FB with slots to receive the drilling tubulars. A drive motor (not shown) is provided to rotate the vertical column including fingerboards to position the drilling tubulars in the storage devices with respect to the pipe rackers. PR1-PR4. The two storage devices are positioned at opposite sides S2, S3 of the drill floor, such that the storage devices and the drill floor are aligned with each other in the thickness direction of the frame FR of the first drilling tower, i.e. they are aligned in a direction parallel to a X direction as indicated in FIG. 4.

Each of the pipe rackers PR1-PR4 is associated with one of the two storage devices SD, and each of the pipe rackers PR1-PR4 is configured to move drilling tubulars between the associated storage device SD and the firing line FL. Each of the casings CA, CA2 of respectively the frames FR, FR2 of the first and second drilling tower support one of the four pipe rackers PR1-PR4. In the prior art, pipe rackers include a vertical column member supporting multiple gripping members, wherein the gripping members can be rotated about a vertical rotation axis by rotation of the vertical column member.

In this embodiment, the vertical column member is omitted and gripping members GM are mounted on the casings CA, CA2 and individually rotated about a vertical rotation axis VRA relative to the casings CA, CA2 by respective actuators. To synchronize the movement of the rotation of the gripping members GM, appropriate control may be provided in which the angular rotation of the gripping members is measured and the actuators are driven based on the measured angular rotation and a desired angular rotation.

The gripping members GM of the pipe rackers are mounted on a motion device, here an articulated arm AA, allowing to displace the respective gripping member GM within a reach outside of the casing CA, CA2. In FIG. 4, the gripping members GM of pipe racker PR1 and PR3 are shown in an extended position, respectively in the firing line FL and in the storage device SD, and gripping members GM of pipe racker PR2 and PR4 are shown in a retracted position. Hence, the pipe rackers are able to move drilling tubulars between one of the storage devices and the firing line. By providing four pipe rackers, two per storage device, redundancy is provided in case of failure of one of the pipe rackers.

The drilling installation of FIGS. 3 and 4 is further provided with weather protective cladding WPC surrounding the drill floor, the first drilling tower, the second drilling tower, and the two storage devices, thereby protecting these components and the spaces in between them from environmental weather conditions, which makes the drilling installation suitable to be used in harsh environments, for instance in arctic regions. The weather protective cladding is preferably attached to the casings CA, CA2 of the first and second drilling tower only.

The drilling installation further comprises draw-works in the form of a winch WI and cables C, which cables C run from the winch to a crown block CB and a traveling block TB via a heave compensator HC. The traveling block TB is mounted to a trolley TR which in turn is guided up and down the first drilling tower using rails R which are attached to the respective casings CA of the frame of the first drilling tower. The traveling block is configured to support a top drive TD to effect drilling. The top drive TD may be temporarily stored between the casings CA of the frame of the first drilling tower at a location indicated by SL. At the location SL, a motion device MD is present to move the top drive between the firing line and the location SL.

The use of locations SL may be possible due to the connection elements CE, CE2 being substantially horizontal and also being the only connection elements between the respective casings CA, CA2, thereby forming rectangular compartments, which can advantageously be used for storing equipment, such as the top drive, but also permanently arranged equipment, e.g. the heave compensator or electronic equipment. The connection elements CE, CE2 may be hollow casings in order to save weight without compromising strength.

The traveling block TB, trolley TR and top drive TD are also shown in a lower position in the firing line in order to show the reach of the draw-works.

The winch WI of the draw-works is preferably located outside the space enclosed by the weather protective cladding WPC, in this case on the outside of the so that in case the space fills with gas, the chances of the winch igniting the gas is minimal. To protect the winch from environmental weather conditions, the winch may be located inside a separate weather protected compartment.

The drilling installation further comprises a cabin CN below each storage device of which a portion can be seen in FIG. 4. The cabins can be used by drilling personnel to oversee the drilling in the firing line and to control the drilling installation from, wherein the advantage of this location is that it provides a good overview of the drilling operations without requiring a lot of space. The pipe rackers may be controlled such that when handling drilling tubulars, the drilling tubulars are never held in a position above one of the two cabins for safety reasons.

The invention claimed is:

1. A vessel including a drilling installation for drilling a well, by means of said installation, which installation comprises:

a substantially rectangular drill floor surrounding a vertically extending firing line;

a first drilling tower arranged on a deck of the vessel, said first drilling tower comprising a vertically extending frame with a length, a width and a thickness, the length of the frame being larger than the width of the frame and the width of the frame being larger than the thickness of the frame, wherein the frame comprises two elongated hollow casings arranged next to each other in the width direction of the frame, said casings extending substantially parallel to a longitudinal axis of the frame, said casings being rigidly connected to each other by one or more connection elements, and said casings being configured to transfer loads applied to the first drilling tower to the vessel, wherein the frame of the first drilling tower is positioned at a side of the drill floor, such that the longitudinal axis of the frame extends parallel to the firing line, and such that the longitudinal axis and the firing line are substantially aligned with each other in the width direction of the frame;

an additional tower support arranged between the deck of the vessel and an elevated position at the first drilling tower;

two storage devices for vertically storing drilling tubulars;

two pipe rackers, each pipe racker being associated with one of the two storage devices, and each pipe racker being configured to move drilling tubulars between the associated storage device and the firing line, wherein the two storage devices are positioned at opposite sides of the drill floor, such that the storage devices and the drill floor are aligned with each other in the thickness direction of the frame of the first drilling tower, and wherein the casings of the frame of the first drilling tower each support one of the two pipe rackers.

2. A drilling installation according to claim 1, including a second drilling tower comprising a vertically extending frame with a length, a width and a thickness, the length of the frame of the second drilling tower being larger than the width of the frame of the second drilling tower, and the width of the frame of the second drilling tower being larger than the thickness of the frame of the second drilling tower, wherein the frame of the second drilling tower comprises two elongated hollow casings arranged next to each other in the width direction of the frame of the second drilling tower, said casings of the frame of the second drilling tower extending substantially parallel to a longitudinal axis of the frame of the second drilling tower, said casings of the frame of the second drilling tower being rigidly connected to each other by one or more connection elements, and said casings of the frame of the second drilling tower being configured to transfer loads applied to the second drilling tower to the vessel, wherein the frame of the second drilling tower is positioned at a side of the drill floor opposite to the frame of the first drilling tower, such that the longitudinal axis of the frame of the second drilling tower extends parallel to the firing line, and such that the longitudinal axis of the frame of the second drilling tower and the firing line are substantially aligned with each other in the width direction of the frame of the second drilling tower, and wherein the second drilling tower is the tower support of the first drilling tower.

3. A drilling installation according to claim 2, wherein the first and second drilling tower are connected to each other at their respective top ends.

4. A drilling installation according to claim 2, comprising two additional pipe rackers, each of the two additional pipe rackers being associated with one of the two storage devices, and each additional pipe racker being configured to move drilling tubulars between the associated storage device and the firing line, wherein the casings of the frame of the second drilling tower each support one of the two additional pipe rackers.

5. A drilling installation according to claim 2, comprising weather protective cladding surrounding the drill floor, the first drilling tower, the second drilling tower and the two storage devices, wherein the cladding is supported by the casings of the first and second drilling tower.

6. A drilling installation according to claim 1, comprising draw-works and a traveling block for supporting a top drive, said draw-works being configured to move the traveling block up and down in the firing line, and wherein the drilling installation further comprises a trolley which is connectable to the traveling block, and rails extending parallel to the firing line and being supported by the casings of the frame of the first drilling tower to guide movement of the trolley along the first drilling tower.

7. A drilling installation according to claim 1, wherein the casings of the frame of the first drilling tower are rigidly connected to each other by one or more substantially horizontal connection elements.

8. A drilling installation according to claim 2, wherein the casings of the frame of the second drilling tower are rigidly connected to each other by one or more substantially horizontal connection elements.

9. A drilling installation according to claim 1, wherein at least one of the one or more connection elements is a hollow casing.

10. A drilling installation according to claim 6, further comprising a weather protective cladding surrounding the drill floor, the first drilling tower, the second drilling tower and the two storage devices, wherein the weather protective cladding is supported by the casings of the first and second drilling tower, and wherein the draw-works comprise a winch that is located outside the space surrounded by the weather protective cladding.

11. A drilling installation according to claim 1, wherein the storage devices are rotary storage devices.

12. A drilling installation according to claim 1, comprising a cabin for drilling personnel, said cabin being arranged at least partially beneath one of the two storage devices.

13. A drilling installation according to claim 1, wherein the frame of the first drilling tower comprises a space in between the two casings of the frame of the first drilling tower to temporarily accommodate equipment.

14. A drilling installation according to claim 7, wherein the casings of the frame of the first drilling tower are rigidly connected to each other by one or more substantially horizontal connection elements only.

15. A drilling installation according to claim 8, wherein the casings of the frame of the second drilling tower are rigidly connected to each other by one or more substantially horizontal connection elements only.

16. A drilling installation according to claim 11, wherein the rotary storage devices each comprise a vertical column and one or more fingerboards supported by the column as well as a drive motor for rotating the rotary storage device.

17. A method of drilling a well, comprising the steps of:
providing a vessel according to claim 1; and
drilling a well with the drilling installation.

* * * * *